United States Patent [19]

Stout

[11] 4,240,545

[45] Dec. 23, 1980

[54] ARTICLE CARRIER

[75] Inventor: James T. Stout, Acworth, Ga.

[73] Assignee: The Mead Corporation, Dayton, Ohio

[21] Appl. No.: 80,262

[22] Filed: Oct. 1, 1979

[51] Int. Cl.[3] ..... B65D 75/00

[52] U.S. Cl. ..... 206/188; 229/28 BC; 229/52 BC; 206/189

[58] Field of Search ..... 206/147, 156, 157, 175, 206/185, 188–191, 183, 162–166; 229/28 BC, 52 BC

[56] References Cited

U.S. PATENT DOCUMENTS

| | | | |
|---|---|---|---|
| 2,322,396 | 6/1943 | Slevin, Jr. | 206/191 |
| 2,932,424 | 4/1960 | Arneson | 206/176 |
| 3,101,865 | 8/1963 | Levkoff et al. | 206/185 |
| 3,191,800 | 6/1965 | Kowal | 206/185 |
| 3,202,313 | 8/1965 | Wainberg | 206/188 |
| 3,306,485 | 2/1967 | Wood | 206/188 |
| 3,722,737 | 3/1973 | Hughes et al. | 206/188 |

*Primary Examiner*—Joseph Man-Fu Moy
*Attorney, Agent, or Firm*—Rodgers & Rodgers

[57] ABSTRACT

An article carrier comprising a bottom panel (1), a pair of side walls (2,3) joined respectively to the side edges of the bottom panel, end wall panels (7,8,11,12) joined respectively to the end edges of the side walls, a pair of medial panels (19,20) joined respectively to the inner edges of the end wall panels at one end of the carrier and extending medially inward of the carrier, a pair of riser panels (15,16) joined respectively to the inner edges of the end wall panels at the other end of the carrier and extending medially inward of the carrier, a handle (23,24,25,26,27) secured to the medial panels and riser panels, a transverse partition strip (66,67,68,69) joined to one side wall and to the handle and extending therebetween, a bottom reinforcement panel (48) disposed in flat face contacting relation with the upper surface of the bottom panel, a pair of supplementary panels (49,50) joined respectively to the side edges of the bottom reinforcement panel and secured respectively in face contacting relation with the inner surfaces of the side walls, a transverse partition (54,55,56,57) secured to the transverse partition strip and to the corresponding supplementary panel, and a locking tab (78) foldably joined to the upper edge of one riser panel and disposed in overlapping relation with a portion of the handle.

9 Claims, 8 Drawing Figures

ARTICLE CARRIER

TECHNICAL FIELD

This invention relates to article carriers utilized in the packaging of multiple primary packages which are large in size. For this reason the carriers must be extremely strong and sturdy.

BACKGROUND ART

Article carriers which embody various forms of reinforcement especially in the area of the carrier bottom panel are known and are exemplified by U.S. Pat. Nos. 2,322,396 and 2,932,424.

DISCLOSURE OF INVENTION

According to this invention, an article carrier is provided and comprises a bottom panel with parallel side walls and end wall panels upstanding therefrom, a pair of medial panels joined respectively to the end wall panels at one end of the carrier and extending medially inward therefrom, a pair of riser panels joined respectively to the end wall panels at the other end of the carrier and extending medially inward therefrom, a handle secured to the medial and riser panels, a transverse partition strip joined at one end thereof to one side wall and at the other end thereof to the handle, a bottom reinforcement panel overlying the bottom panel, a supplementary panel joined to each side edge of the bottom reinforcement panel, and a transverse partition secured to the transverse partition strip and foldably joined to the corresponding supplementary panel.

BEST MODE FOR CARRYING OUT THE INVENTION

Figure 1:
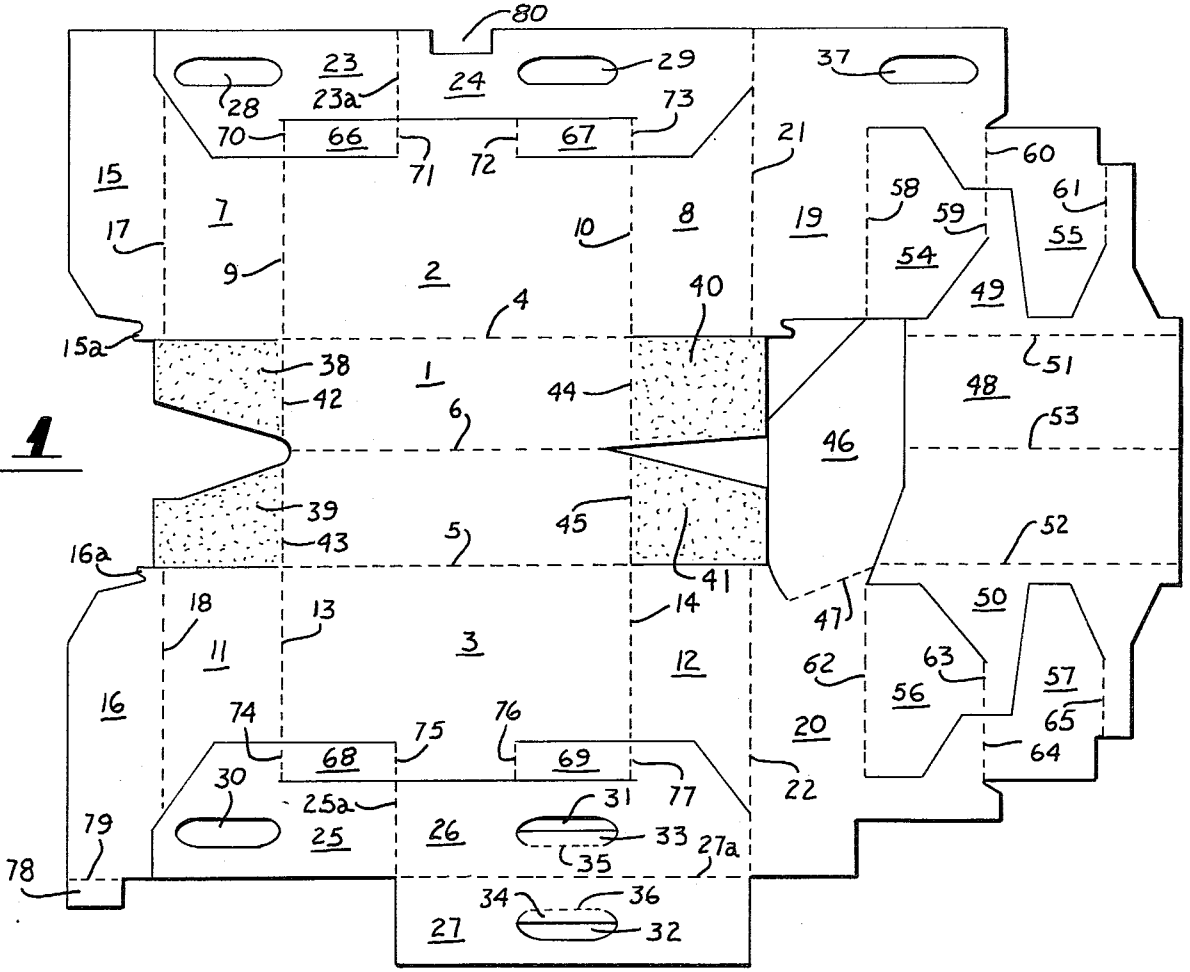
FIG. 1 is a plan view of the blank from which the carrier is formed according to this invention.

In the drawings the numeral 1 depicts the bottom panel of the article carrier to the side edges of which side walls 2 and 3 are foldably joined respectively along fold lines 4 and 5. In addition bottom panel 1 is provided with medial fold line 6.

End wall panels 7 and 8 are foldably joined respectively to the end edges of side wall 2 along fold lines 9 and 10. Likewise end wall panels 11 and 12 are foldably joined respectively along fold lines 13 and 14 to the end edges of side wall 3.

The medial partitioning structure for the carrier is provided at one end of the blank in the form of riser panels 15 and 16 which are foldably joined respectively to end wall panels 7 and 11 along fold lines 17 and 18 and which are provided respectively with locking notches 15*a* and 16*a*. At the other end of the blank, the medial partitioning structure is provided in the form of medial panels 19 and 20 which are foldably joined respectively to end wall panels 8 and 12 along fold lines 21 and 22.

The handle for the carrier is formed in part from multiple handle panels which are identified in the drawings by the numerals 23, 24, 25, 26 and 27. Hand gripping apertures 28, 29, 30, 31 and 32 are formed respectively in handle panels 23–27. In addition hand cushioning flaps 33 and 34 are foldably joined respectively to handle panels 26 and 27 along fold lines 35 and 36. Also handle panel 23 is foldably joined to handle panel 24 along fold line 23*a*. Likewise handle panel 25 is foldably joined to handle panel 26 along fold line 25*a* and handle panel 27 is foldably joined to handle panel 26 along fold line 27*a*. To complete the carrier handle structure, the upper portion of medial panel 19 in effect forms a portion of the handle and is provided with hand gripping aperture 37.

In order to provide additional strength in the area of the bottom of the carrier, bottom flaps 38, 39, 40 and 41 are provided and are foldably joined respectively to bottom panel 1 along fold lines 42, 43, 44 and 45. Also additional medial partitioning means is provided in the form of medial partition panel 46 which is foldably joined to medial panel 20 along diagonal fold line 47.

According to a feature of this invention, bottom reinforcement panel 48 is provided to the side edges of which supplementary panels 49 and 50 are foldably joined respectively along fold lines 51 and 52. In addition bottom reinforcement panel 48 is provided with medial fold line 53.

Transverse partitioning means for the carrier is provided in part in the form of transverse partitions 54, 55, 56 and 57. More specifically transverse partition 54 is foldably joined respectively to medial panel 19 and supplementary panel 49 along fold lines 58 and 59. Similarly transverse partition 55 is foldably joined to medial panel 19 along fold line 60 and to supplementary panel 49 along fold line 61. Transverse partition 56 is foldably joined to medial panel 20 along fold line 62 and is foldably joined to supplementary panel 50 along fold line 63. Finally transverse partition panel 57 is foldably joined respectively to medial panel 20 and supplementary panel 50 along fold lines 64 and 65.

Additional transverse partitioning means is provided in the form of transverse partition strips 66, 67, 68 and 69. More specifically transverse partition strip 66 is foldably joined respectively to handle panel 23 and side wall 2 along fold lines 70 and 71. In similar fashion transverse partition strip 67 is foldably joined to side wall 2 along fold line 72 and to handle panel 24 along fold line 73. Transverse partition strip 68 is foldably joined to handle panel 25 along fold line 74 and to side wall 3 along fold line 75. Finally transverse partition strip 69 is foldably joined respectively to side wall 3 and handle panel 26 along fold lines 76 and 77.

According to another feature of this invention, locking tab 78 is provided and is foldably joined to riser panel 16 along fold line 79. For the purpose of cooperating with locking tab 78, notch 80 is formed in handle panel 24.

In order to form the carrier from the blank shown in FIG. 1, initially it is necessary to apply glue to bottom flaps 38, 39, 40 and 41 as shown by stippling in FIG. 1. Thereafter bottom flaps 38, 39, 40 and 41 are folded inwardly respectively along fold lines 42, 43, 44 and 45 to occupy the positions shown in FIG. 2. By this operation bottom flaps 38–41 are adhered to bottom panel 1.

Figure 2:
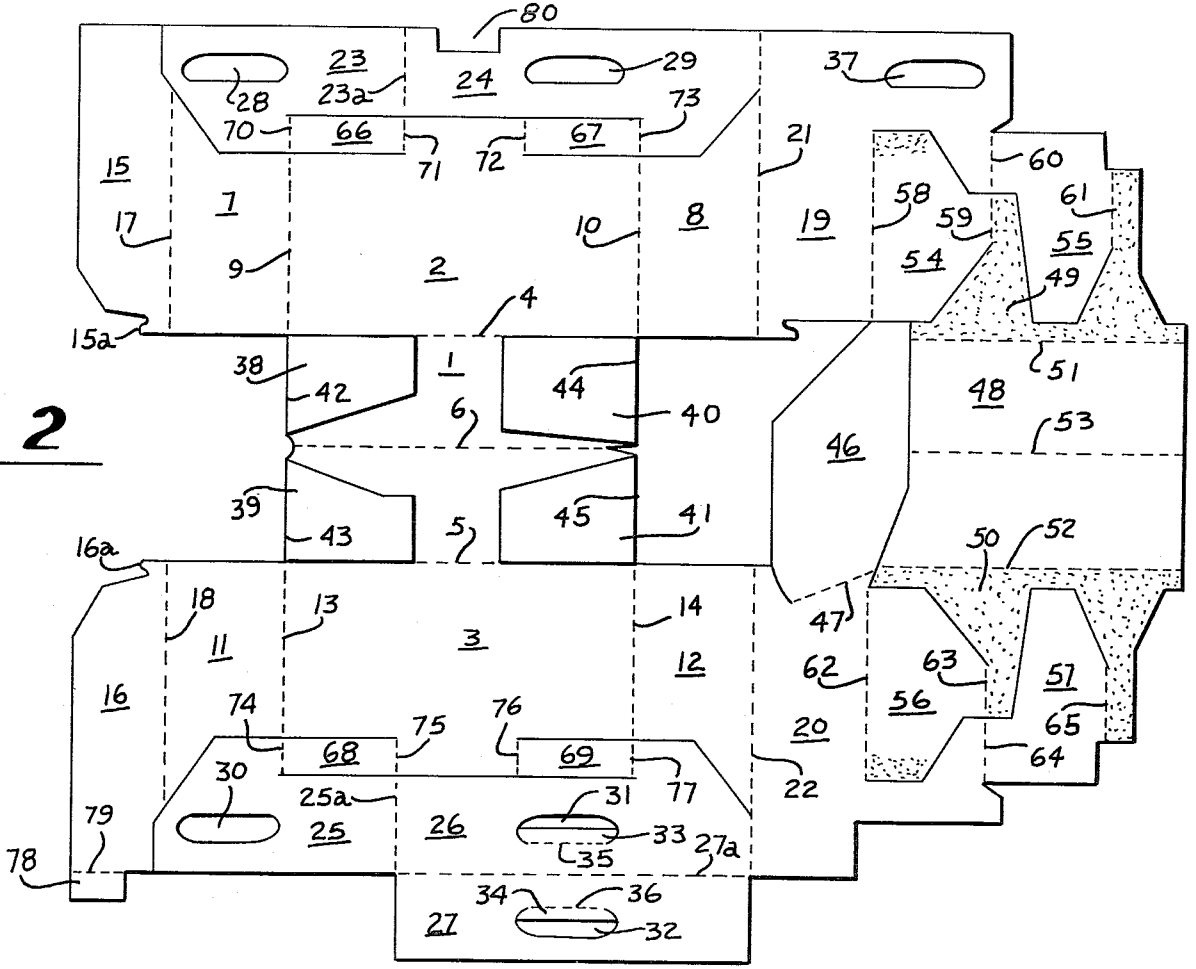
FIGS. 2, 3, 4, 5 and 6 depict intermediate stages through which the blank of FIG. 1 is folded and manipulated into a complete and collapsed carrier as shown in FIG. 7.

Then an application of glue is made to supplementary panels 49 and 50 as well as to portions of transverse partitions 54 and 56 as shown by stippling in FIG. 2.

Figure 3:
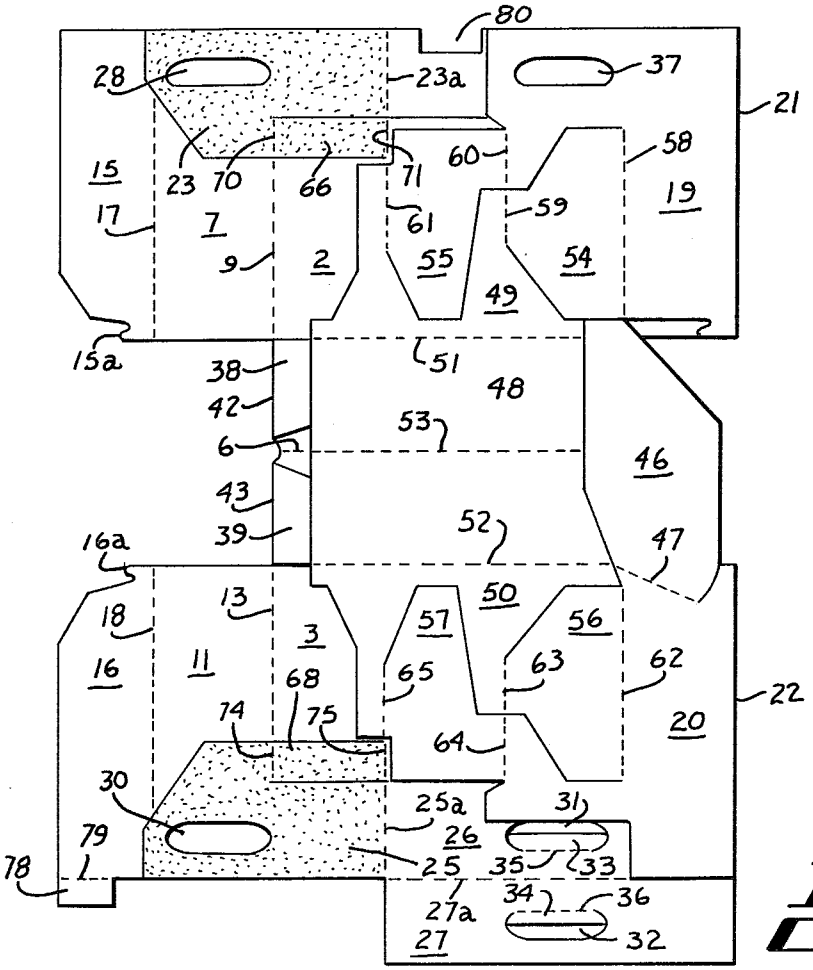

Thereafter the carrier medial structure as well as bottom reinforcement panel 48, supplementary panels 49 and 50, and transverse partitions 54, 55, 56 and 57 are all elevated and folded over to the left along fold lines 21 and 22 to occupy the positions depicted in FIG. 3. By this operation supplementary panels 49 and 50 are adhered respectively to the inner surfaces of side walls 2 and 3. In addition the upper portion of transverse partition 54 is adhered to transverse partition strip 67 and, likewise, the upper portion of transverse partition 56 is adhered to transverse partition strip 69. The carrier then appears as shown in FIG. 3.

Figure 4:
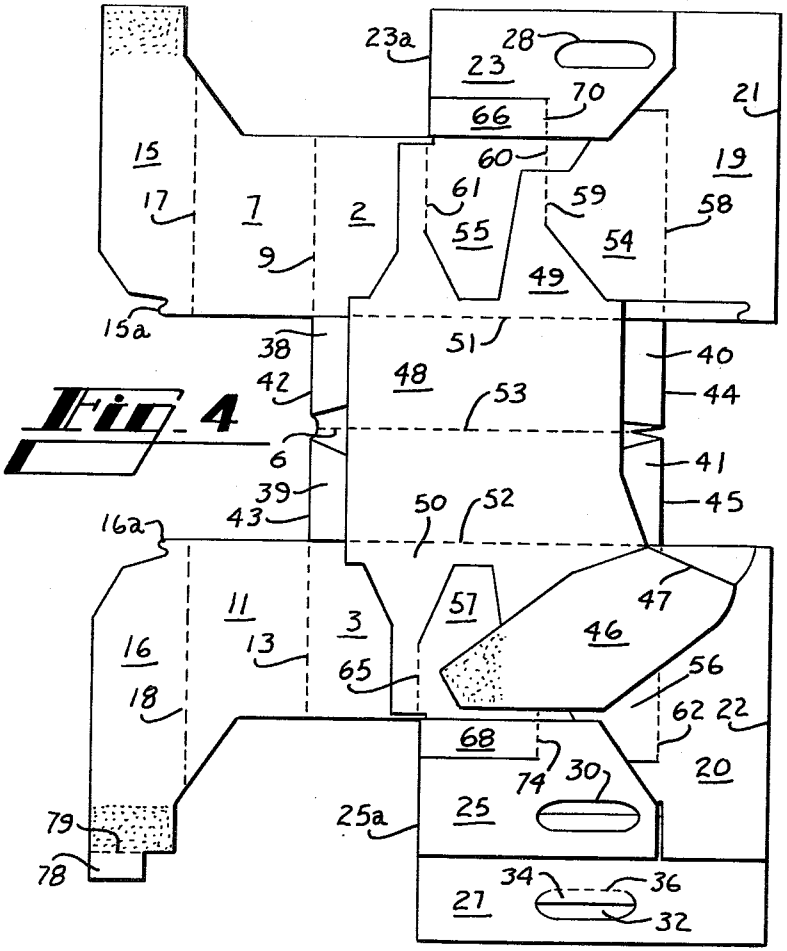

Following this medial partition panel 46 is elevated and folded over along diagonal fold line 47 to occupy the position shown in FIG. 4. In addition glue is applied to handle panels 23 and 25 as well as to transverse partition strips 66 and 68 as shown by stippling in FIG. 3. This structure is then elevated and folded over to the right along fold lines 23*a*, 25*a*, 71 and 75 to occupy the positions shown in FIG. 4. In this manner handle panel 23 is adhered to handle panel 24 and to medial panel 19. In addition transverse partition strip 66 is adhered to transverse partition 55. In like manner handle panel 25 is adhered to handle panel 26 as well as to medial panel 20 and transverse partition strip 68 is adhered to transverse partition 57.

Then glue is applied to riser panels 15 and 16 as indicated by stippling in FIG. 4. Following this riser panels 15 and 16 and end wall panels 7 and 11 are elevated and folded over to the right along fold lines 9 and 13 to occupy the positions shown in FIG. 5. By this operation riser panels 15 and 16 are adhered to handle panels 23 and 25 respectively and, in addition, riser panel 16 is adhered to a portion of medial partition panel 46.

Figure 5:
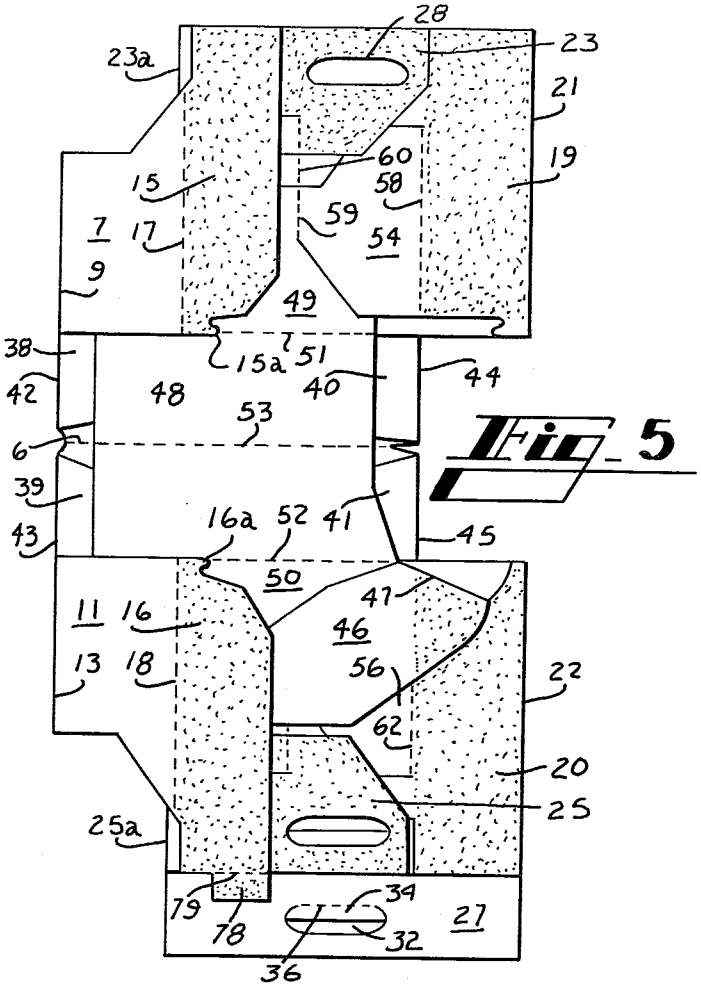

Thereafter glue is applied to the carrier as shown by stippling in FIG. 5. More specifically glue is applied to riser panels 15 and 16, handle panels 23 and 25, medial panels 19 and 20, and medial partition panel 46. Then the entire upper portion of the carrier as viewed in FIG. 5 is elevated and folded over along medial fold lines 6 and 53 to occupy the position shown in FIG. 6.

Figure 6:
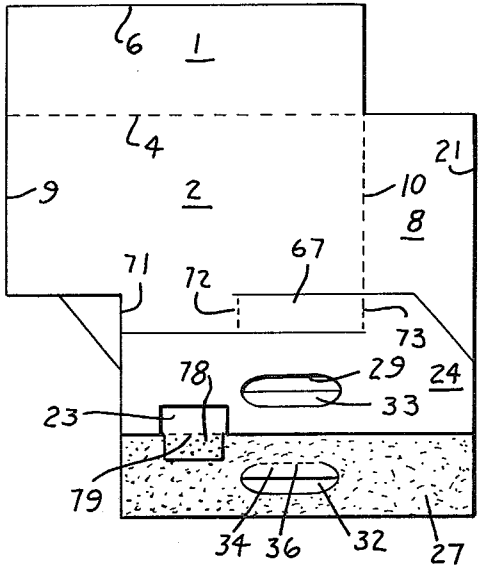

In order to complete the formation of the carrier, glue is applied to handle panel 27 and to locking tab 78 as shown by stippling in FIG. 6. Finally handle panel 27 is elevated and folded over along fold line 27*a* and adhered to handle panel 24. In addition, by this operation, locking tab 78 is folded into flat face contacting and interlocking relationship with handle panel 23. The carrier then appears as shown in FIG. 7 which represents the completed carrier in collapsed condition.

Figure 8:
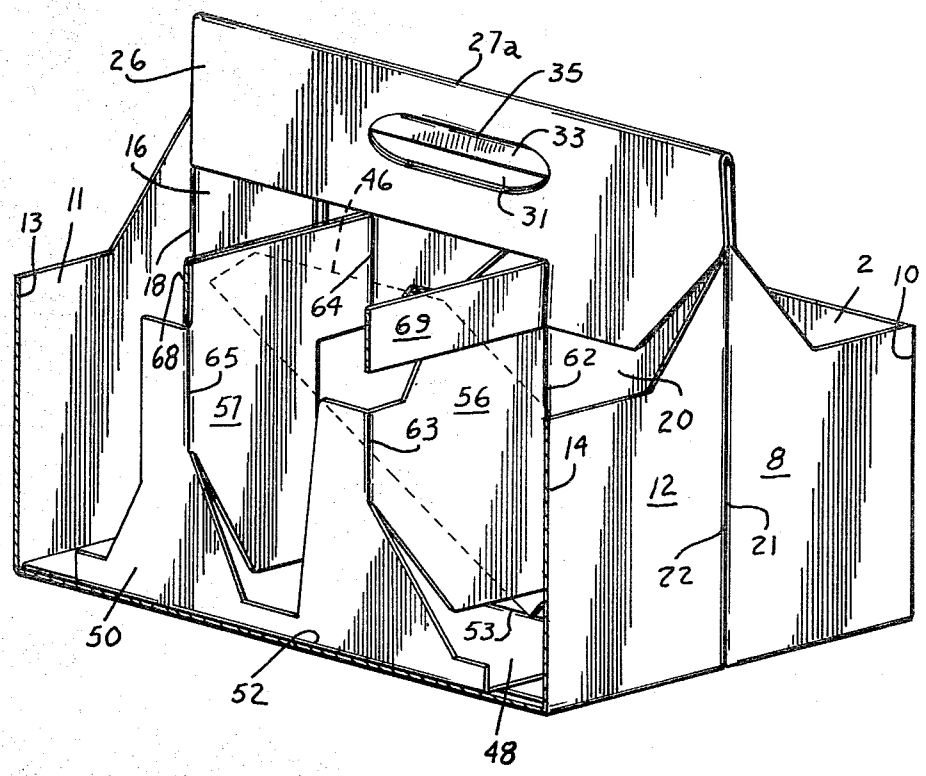
FIG. 8 is an isometric view of an erected carrier formed according to this invention and with one side wall broken away.
Figure 7:
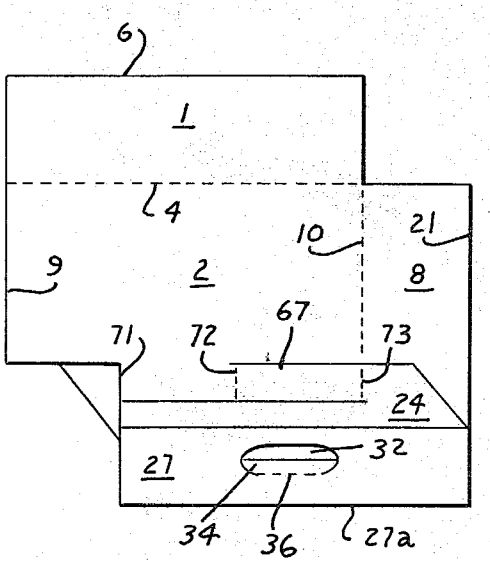

In order to set up the carrier from its collapsed condition as shown in FIG. 7 into the condition shown in FIG. 8, it is necessary to rotate the carrier, as shown in FIG. 7, 180°. Then it is simply necessary to prevent longitudinal movement of side walls 2 and 3 and to apply an inward force to the medial edges of end wall panels 8 and 12. This expands the carrier and moves the side walls apart. Simultaneously bottom panel 1 and bottom reinforcing panel 48 fold into flat planes. The carrier is then maintained in set up condition by cooperation between locking notches 15*a* and 16*a* and one end of bottom panel 1 and appears as shown in FIG. 8.

Therefore by this invention an article carrier is provided with a reinforced bottom and with the bottom reinforcement panel being directly secured to the carrier side walls by means of supplementary panels 49 and 50. In addition the lower portion of the carrier is directly connected to the upper portion by means of the interconnection between the supplementary panels and the transverse partition strips by means of the corresponding transverse partitions. Also the carrier handle is secured together by the overlapping of locking tab 78 with at least one of the carrier handle panels.

INDUSTRIAL APPLICABILITY

By this invention an article carrier is provided which is ideally suited to the packaging of the currently widely used large primary packages due to the added strength achieved and the corresponding reduction of structural failure.

I claim:

1. An article carrier comprising a bottom panel (1), a pair of side walls (2,3) foldably joined respectively to the side edges of said bottom panel, end wall panels (7,8,11,12) foldably joined respectively to the end edges of said side walls and extending inwardly of the carrier, a pair of medial panels (19,20) foldably joined respectively to the inner edges of said end wall panels at one end of the carrier and extending medially inward of the carrier, a pair of riser panels (15,16) foldably joined respectively to the inner edges of said end wall panels at the other end of the carrier and extending medially inward of the carrier, a multiple ply handle (23,24,25,26,27) secured to said medial panels and said riser panels, a transverse partition strip (66,67,68,69) joined at one end thereof to one of said side walls and at the other end thereof to said handle and extending therebetween, a bottom reinforcement panel (48) disposed in flat face contacting relation with the upper surface of said bottom panel, a pair of supplementary panels (49,50) joined respectively to the side edges of said bottom reinforcement panel and secured respectively in face contacting relation with the inner surfaces of said side walls, and characterized by a transverse partition (54,55,56,57) secured to said transverse partition strip and foldably joined to the corresponding one of said supplementary panels.

2. An article carrier according to claim 1 and further characterized by a medial partition panel (46) foldably joined to one of said medial panels.

3. An article carrier according to claim 2 and further characterized by said medial partition panel being joined to said medial panel along a diagonal fold line (47).

4. An article carrier according to claim 1 and further characterized by a bottom flap (38,39,40,41) foldably joined to each end of said bottom panel and disposed intermediate said bottom panel and said bottom reinforcement panel.

5. An article carrier according to claim 1 and further characterized by a locking tab (78) foldably joined to the upper edge of one of said riser panels and disposed in overlapping relationship with a portion of said handle.

6. An article carrier according to claim 5 and further characterized by said handle comprising multiple handle panels, a notch (80) formed along the upper edge of one of said handle panels, and said locking tab being disposed in said notch and being substantially coplanar with said one handle panel.

7. An article carrier comprising a bottom panel (1), a pair of side walls (2,3) foldably joined respectively to the side edges of said bottom panel, end wall panels (7,8,11,12) foldably joined respectively to the end edges of said side walls and extending inwardly of the carrier, medial partitioning structure comprising a pair of medial panels (19,20) and a pair of riser panels (15,16), said pair of medial panels being foldably joined respectively to the inner edges of said end wall panels at one end of the carrier and extending medially inward of the carrier, said pair of riser panels being foldably joined to the inner edges of said end wall panels at the other end of the carrier and extending medially inward of the carrier, a handle (23,24,25,26,27) secured to said medial panels and said riser panels, said handle comprising multiple handle panels, and characterized by a locking tab (78) foldably joined to the upper edge of a portion of said medial partitioning structure and disposed in overlapping relationship with at least one of said handle panels.

8. An article carrier according to claim 7 and further characterized by a notch (80) formed in another of said handle panels, said locking tab being disposed in said notch, and said locking tab and said another handle panel being substantially coplanar.

9. An article carrier according to claim 7 and further characterized by said locking tab being foldably joined to one of said riser panels.

* * * * *